US005936391A

United States Patent [19]

Larsen et al.

[11] Patent Number: 5,936,391

[45] Date of Patent: Aug. 10, 1999

[54] PARTIALLY TEMPERATURE COMPENSATED LOW NOISE VOLTAGE REFERENCE

[75] Inventors: Frode Larsen, Tinton Falls, N.J.; Douglas George Marsh, Bethlehem, Pa.; Dewayne Alan Spires, Plaistow, N.H.

[73] Assignee: Lucent Technologies, Inc., Murray Hill, N.J.

[21] Appl. No.: 08/943,073

[22] Filed: Oct. 1, 1997

[51] Int. Cl.[6] ..... G05F 3/16; G05F 1/10; G05F 3/02

[52] U.S. Cl. ..... 323/313; 327/539

[58] Field of Search ..... 323/313, 314, 323/316; 327/539

[56] References Cited

U.S. PATENT DOCUMENTS 4,313,083 1/1982 Gilbert et al. ..... 323/313
5,047,707 9/1991 Dixon et al. ..... 323/314
5,184,061 2/1993 Lee et al. ..... 323/313
5,394,078 2/1995 Brokaw ..... 323/313
5,434,533 7/1995 Furutani ..... 327/538
5,563,504 10/1996 Gilbert et al. ..... 323/313

*Primary Examiner*—Peter S. Wong
*Assistant Examiner*—Bao Q. Vu
*Attorney, Agent, or Firm*—Darby & Darby

[57] ABSTRACT

A reference voltage source has at least one transistor having a base, emitter and collector electrode operating in an active state that has an inherent voltage drop between its base and emitter electrodes to generate a low noise core voltage which is applied to the input of an amplifier to set the amplifier operating point, and thereby the amplifier output, which is the reference voltage. The reference voltage is temperature compensated by providing the amplifier with a feedback loop, or by altering the core voltage applied to the amplifier, or by altering the gain of the amplifier. Several transistors can be connected in series and their base to emitter voltage drops added to change the core voltage value.

9 Claims, 3 Drawing Sheets

PARTIALLY TEMPERATURE COMPENSATED LOW NOISE VOLTAGE REFERENCE

FIELD OF THE INVENTION

The invention relates to a low noise reference voltage source that is partially temperature compensated.

BACKGROUND OF THE INVENTION

In various applications there is a need for a source of a stable reference voltage. For example, in an IC chip containing a large number of circuits, a reference voltage is used to set input reference levels for some of the circuits that receive other signals. It is preferred that the reference voltage source be made a part of the IC chip using the same fabrication technology so as to avoid the use of external components and reduce cost. Also, it is desirable to generate the reference voltage with low noise characteristics so as not to adversely affect the signals of the circuits in which it is used. Further, it is desirable for the reference voltage source to be temperature compensated to as great an extent as possible.

SUMMARY OF THE INVENTION

It is a general object of my invention to provide a low noise and stable reference voltage for an IC chip. It is a further object of my invention to provide temperature compensation for the reference voltage source.

In accordance with my invention, an IC chip is fabricated with one or more transistors. The inherent base emitter voltage drop of an active (conducting) transistor establishes a low noise core voltage and the drops of several such transistors can be added in series to increase the core voltage value. The core voltage is applied to the input of an amplifier and is amplified to produce a somewhat noisier, but still relatively low noise, output reference voltage to be used for other circuits. The reference voltage is temperature compensated by providing the amplifier with a feedback loop, or by altering the core voltage applied to the amplifier, or by altering the gain of the amplifier.

BRIEF DESCRIPTION OF THE DRAWINGS

The foregoing and other objects and advantages of my present invention will become more apparent upon reference to the following detailed description and the annexed drawings in which.

DETAILED DESCRIPTION OF THE INVENTION

Figure 1:
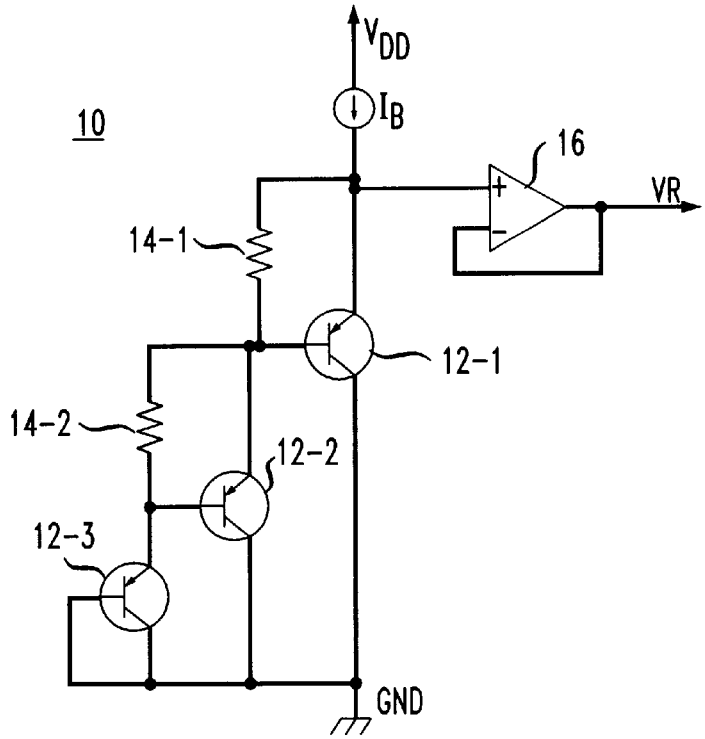
FIG. 1 is a schematic diagram of one illustrative embodiment of my invention of a low noise core voltage generator.

FIG. 1 shows a circuit 10 for producing the low noise reference voltage VR. The circuitry of the invention is preferably implemented by integrated circuit (IC) production techniques as part of an IC chip containing one or more other circuits which are to utilize the reference voltage. Generator 10 is biased by a current source IB from a voltage supply $V_{DD}$ and is illustratively shown as having three bipolar PNP transistors 12-1, 12-2 and 12-3 connected in series in a manner to produce the sum of the inherent base to emitter VBE voltage drops of the three transistors. That is, the emitter of transistor 12-1 receives the current source IB and its collector is connected to ground. The base of transistor 12-1 is connected to the emitter of transistor 12-2 and the base of transistor 12-2 connected to the emitter of transistor 12-3. The collector of each of the transistors 12-2 and 12-3 is also connected to ground.

A resistor 14-1 connects the junction of the base of transistor 12-1 and the emitter of transistor 12-2 to the IB bias current. A resistor 14-2 is connected from this junction to the junction of the base of transistor 12-2 and the emitter of transistor 12-3. That is, resistors 14-1 and 14-2 supply operating current to the transistors 12-2 and 12-3. Separate current sources from $V_{DD}$ could be alternately used (not shown).

Each of the transistors 12 is operated in an active state due to the voltages applied to its emitter and base and the grounding of its collector. There is an inherent voltage drop VBE produced by each transistor 12 in its active state and the VBE voltage drops of the three transistors add in series to produce a core voltage.

The sum of the VBE voltage drops of the three transistors 12 appears at the emitter of transistor 12-1 and is applied as the core voltage to the non-inverting (+) input of a conventional low noise operational amplifier 16 having the usual feedback path. Low noise resistors (not shown) could be used to add gain to this amplifier stage. The output of amplifier 16 is the reference voltage VR. This voltage has relatively low noise since the transistors 12 inherently have a low noise output when operating in an active state to produce the core voltage.

Figure 2:
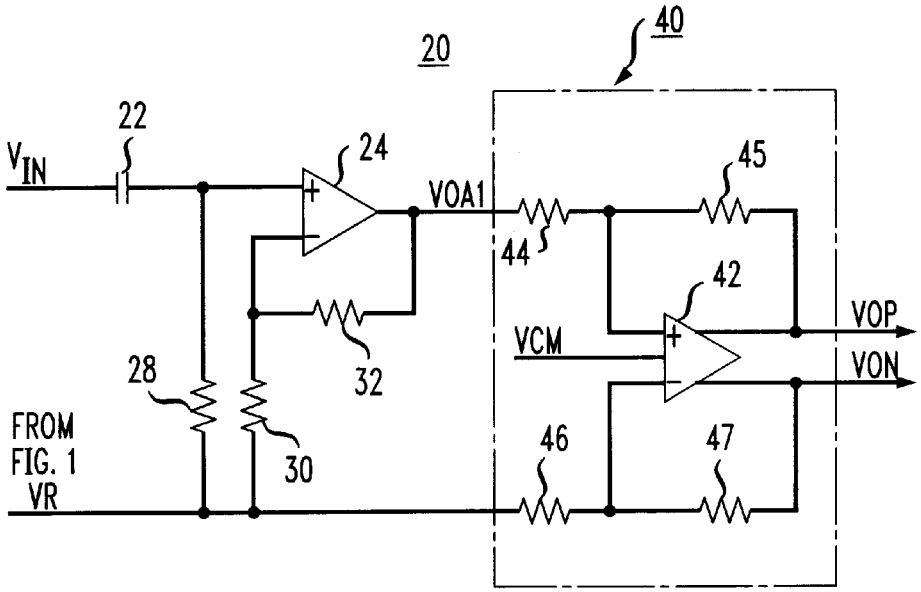
FIG. 2 is a schematic diagram of a balanced converter utilizing the low noise reference voltage generator.

FIG. 2 shows a single-ended input to balanced output converter utilizing the voltage from the low noise reference voltage source 10 of FIG. 1. The converter can be on the same integrated circuit chip as the reference voltage source. Here, the single-ended converter input signal VIN is supplied through a capacitor 22 to the non-inverting (+) input of an operational amplifier 24. The input signal can be either of the analog or digital type. Bias voltage is supplied by resistors 28 and 30 to the non-inverting (+) and inverting (−) inputs of amplifier 24 from the reference voltage VR source, such as produced by circuit 10 of FIG. 1. A resistor 32 is provided as the feedback element for amplifier 24 between its output and inverting (−) input.

Amplifier 24 has a single-ended output VOA1 that is to be converted to a fully balanced output, that is, two signals of opposite phase. To accomplish this, a converter 40 is provided. Converter 40 has an operational amplifier 42 whose non-inverting input (+) receives the amplified, single-ended, input signal VOA1 through a resistor 44 and produces opposed phase positive and negative output signals VOP and VON. The inverting input (−) of the amplifier is biased with the reference voltage VR through resistor 46. Resistors 45 and 47 provide the feedback from the respective positive output and the negative output of the amplifier 42 back to each of the corresponding amplifier non-inverting and inverting inputs.

Any noise introduced at either of the inverting or non-inverting input nodes of amplifier 24 will be added directly to the input VIN signal. The converter amplifier 42 of FIG.

2 cannot distinguish between noise fed into node VR and a signal fed into node VOA1. However, noise added to VCM, the common mode input of amplifier 42, will be added as a common mode output signal, and thus will be rejected by the common mode rejection of the system. The common mode is defined as the average of the inputs or outputs. Typically, the common mode of the amplifier input and output are the same, and typically this is a DC voltage which can be generated either within the amplifier or externally. It is well known that in well designed balanced amplifiers, variations and noise on the common mode terminal are highly attenuated when the outputs are viewed differentially (VOP–VON). Thus, a well regulated noisier reference can be used for the amplifier 42 to provide a well defined common mode output of the overall stage.

VR is based on the three VBE drops of the transistors 12, and has a theoretical temperature dependency that is typically about −6 mV/C°. Thus, VR could vary as much as from 2.1 V to 1.4 V as the temperature goes from −40° C. to +85° C. By incorporating the low noise reference voltage source in a feedback loop with variable gain, the low noise reference voltage can be altered to keep it within a certain range of a fixed temperature-independent reference. This could be done by altering the reference itself, or altering the external gain.

Figure 3:
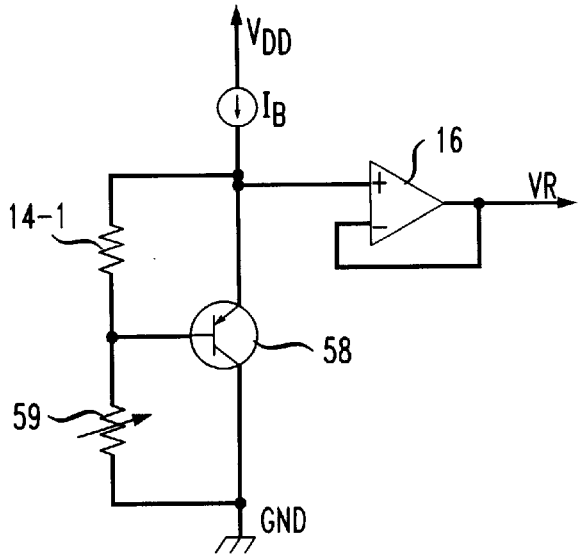
FIG. 3 is a schematic diagram of an illustrative embodiment of my invention providing temperature compensation to adjust the low noise core voltage.

FIG. 3 shows one possible arrangement for adjusting the reference voltage VR. The same reference numerals are used for the same components shown in FIG. 1. Here, there is a single PNP transistor 58 whose emitter is directly connected to the bias current IB and whose base is also connected to the emitter by resistor 14-1. A variable resistor 59 connects the base to ground. The collector of transistor 58 is also connected to ground. Resistor 59 is of the temperature sensitive type so that its resistance value varies based on the operating temperature. Adjusting the variable resistor 59 sets the conduction point of transistor 58, which sets the voltage at the non-inverting input (+) of the operational amplifier 16. This controls the output reference voltage VR of the amplifier.

Figure 4:
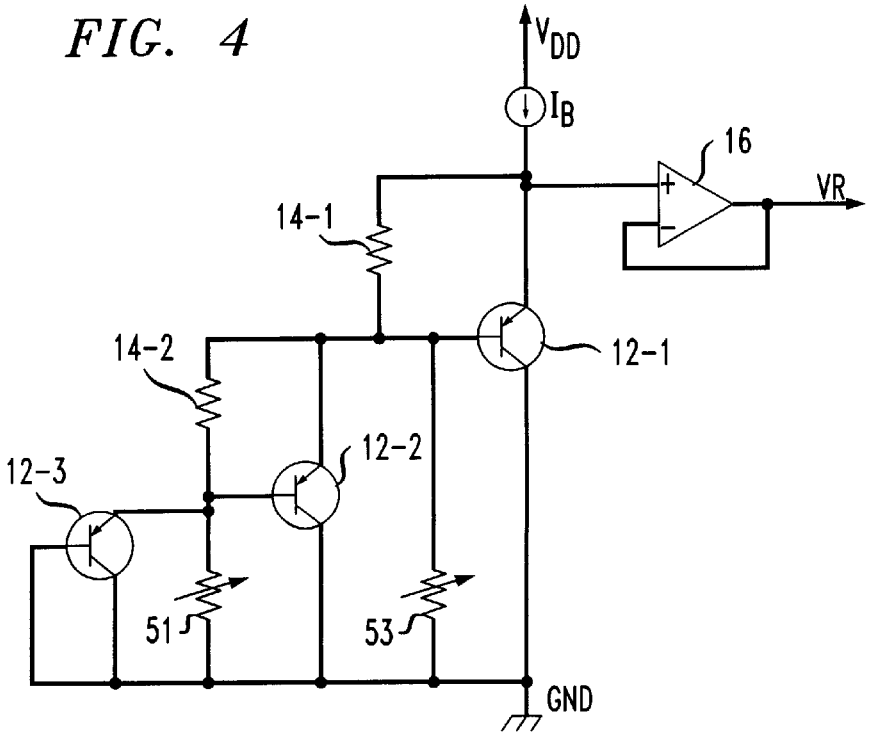
FIG. 4 is a diagram of a further illustrative embodiment which is a modification of the circuit of FIG. 3.

FIG. 4 shows an alternate way to compensate for variations in the emitter-base voltage with temperature by adjusting the current through the bottom two transistors 12-2 and 12-3 of the VR generator. The circuit of FIG. 4 corresponds to that of FIG. 1 and the same reference numerals are used for the same components. Here, a variable resistor 51 is connected from the emitter of transistor 12-3 to ground and a variable resistor 53 is connected from the emitter of transistor 12-2 to ground. The resistors 51 and 53 are temperature sensitive.

By increasing the resistance value of resistor 51 as ambient temperature increases, more current will flow through the transistor 12-3 emitter-base junction, and by increasing the value of resistor 53, more current will flow through the emitter-base junction of transistor 12-2. Basically, the resistors 51 and 53 have temperature coefficients of a value to offset the temperature induced VBE variation of the transistors 12.

The circuit implementation of FIG. 4 has a somewhat limited output range and might not be suitable for some applications. As the currents through the bipolar transistor devices 12 drop, the noise will also increase, due to added shot noise. However, the simplicity of the implementation makes it a suitable implementation where the temperature range is reasonably small and the required output voltage VR is at a suitable level.

The low noise reference voltage VR can be generated in accordance with FIGS. 1, 3 and 4, and an amplifier can be used to amplify this low noise voltage to a desired target value. This can be implemented in a continuous fashion, for example, by using a continuously variable MOS resistor.

Figure 5:
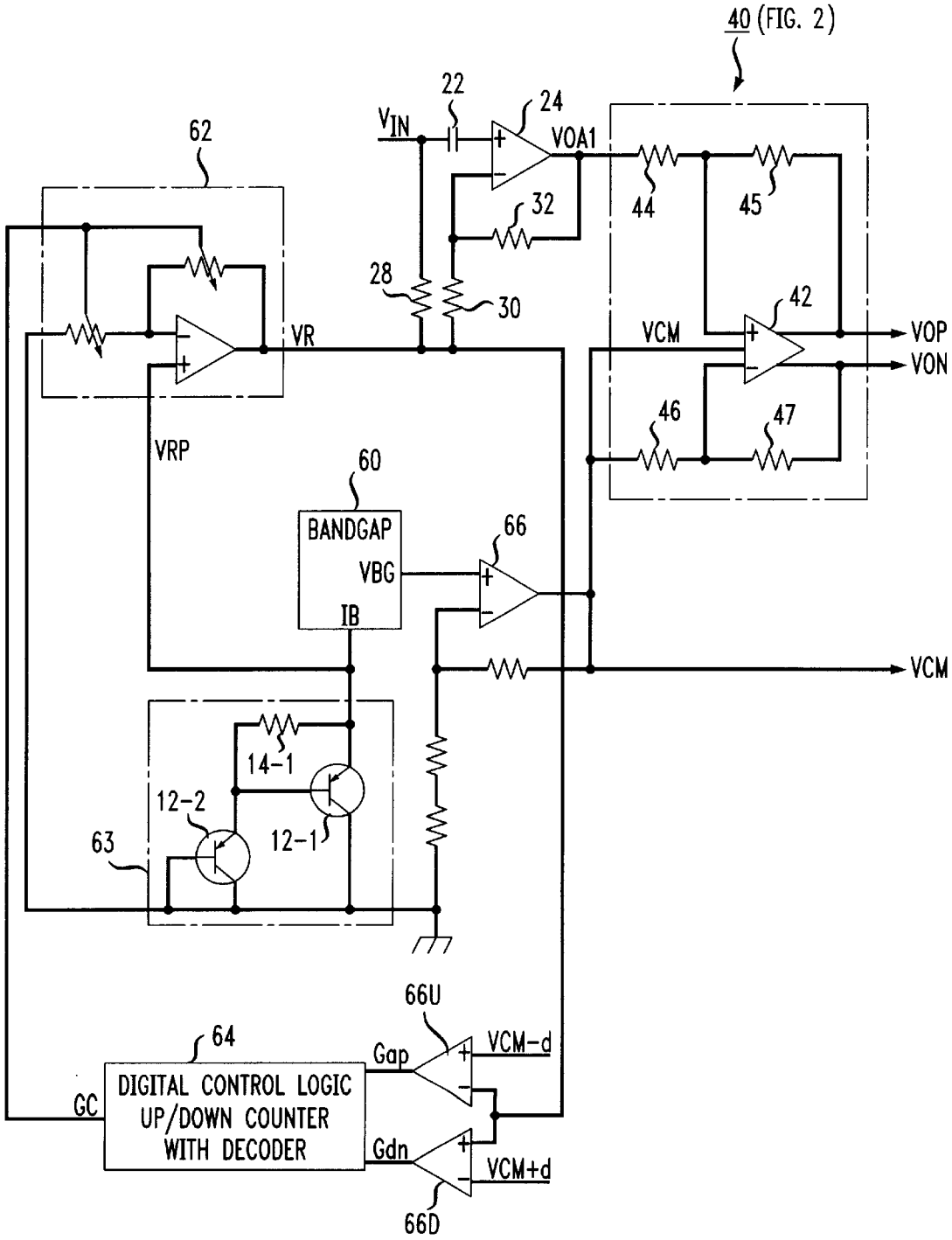
FIG. 5 is a schematic diagram of a circuit illustrative of an embodiment of my invention for adjustment of the gain of an amplifier producing the reference voltage.

The target value also can be obtained by using a programmable gain amplifier and stepping the gain in discrete intervals. An implementation of this is shown in FIG. 5. In FIG. 5, the portion of the low noise reference voltage source of FIG. 1 that produces the core voltage is designated 63, the converter of FIG. 2 is again designated as 40 and the other components of FIG. 2 have the same reference numerals.

In FIG. 5, IB is the bias current and is supplied from a bandgap voltage reference 60 which provides a bins to the reference source 63 to provide the low noise core voltage, here designated VRP. The bandgap circuit 60 is of a standard well known configuration. The core voltage VRP is applied to the non-inverting (+) input of an amplifier 62 and is amplified and fed back as the reference voltage VR to the respective connected (−) and (+) inputs of the two similar comparators 66U and 66D. Bandgap 60 also produces an output voltage VBG which is applied to the non-inverting (+) input of an amplifier 61 whose output is VCM, which is used to reference the common mode of the converter amplifier 42.

By any conventional means, voltages are generated above (VCM+d) and below (VCM−d) a target voltage VCM. This gives a range of 2d relative to the center reference target VCM. The voltage VCM+d is applied to the non-inverting (+) input of comparator 66U while voltage VCM−d is applied to the inverting input (−) of comparator 66D. The comparators 66U and 66D each produces a respective output voltage Gup and Gdn, respectively, when its input voltage VCM+d and VCM−d is compared with VR. As described above, VCM may be noisy without degrading differential signal performance. VCM +d and VCM−d are selected as required by system requirements to maintain all voltages within the required operating range. The value for 2d is set sufficiently high so that the switching of the steps of VR will be relatively slow and due only to temperature effects and not to any random noise.

A digital control logic circuit 64 adjusts the gain of amplifier 62 to keep its VR output between VCM−d and VCM+d, where VCM is the common mode voltage of the amplifier 42 in converter 40. The digital logic circuit 64 has two inputs, one the output voltage Gup of comparator 66U and the other the output voltage Gdn of comparator 66D.

Logic circuit 64 includes an up/down counter 64 that is controlled by the voltages Gup and Gdn at the outputs of the two comparators 66U and 66D so as to count up or down. A decoder in circuit 64 decodes the counter output and produces a gain control output voltage GC that sets the appropriate gain in amplifier 62. This is done by conventional circuitry. As illustratively shown, amplifier 62 has a variable feedback resistor 68 between its output and non-inverting input and a variable resistor 69 between its non-inverting input and ground. The output voltage GC of logic circuit 64 controls the values of one or both of resistors 68 and 69, and thereby the gain of amplifier 62 which sets the reference voltage VR. Amplifier 62 needs to have low noise characteristics, but since speed and input range are limited, this is not a difficult problem.

The trip points of the comparators 66U and 66D, which are VCM−d and VCM+d, are set relative to a fixed, non-temperature dependent voltage VCM, as provided by the bandgap. Thus, VR is maintained to the target voltage VCM, which is advantageous for various reasons in circuit design.

We claim:

1. A reference voltage source comprising:

a core voltage generator for producing a core voltage including a transistor having a base, emitter and collector electrode;

the emitter and collector of said transistor being connected between a current supply and a common potential point, and the base being connected to said common potential point, said transistor having an inherent voltage drop between said base and said emitter electrodes which is the core voltage;

a temperature sensitive resistor connected between the base of said transistor and said common potential point to vary the base to emitter voltage drop to compensate the core voltage for temperature changes; and an amplifier having a first input with said core voltage applied thereto to set the amplifier operating point, a second input for receiving a signal to control the gain of said amplifier, the amplifier output comprising the reference voltage.

2. A reference voltage source as in claim 1, wherein said core voltage generator comprises a plurality of said transistors connected in series emitter to base between said current supply and said common potential point, the base to emitter voltage drops of said plurality of transistors adding together to form the core voltage to be applied to said amplifier input.

3. A reference voltage source as in claim 2, wherein said temperature sensitive resistor is connected between the base of at least one of said transistors and said common potential point.

4. A reference voltage source comprising:

a core voltage generator for producing a core voltage including a transistor having base, emitter and collector electrodes;

the emitter and collector of said transistor being connected between a current supply and a common potential point, and the base being connected to said common potential point, said transistor having an inherent voltage drop between said base and said emitter electrodes which is the core voltage;

an operational amplifier having a first input with said core voltage applied thereto to set the amplifier operating point, a second input for receiving a signal to control the gain of said amplifier, the amplifier output comprising the reference voltage, and a feedback connection comprising a variable impedance between the output of said amplifier and said amplifier second input to provide a signal to control the gain of said amplifier and the magnitude of said reference voltage at the output of said amplifier.

5. A reference voltage source as in claim 4, further comprising a source of a target voltage, and a circuit for varying said feedback element to vary the gain of said amplifier to set said reference voltage with reference to said target voltage.

6. A reference voltage source as in claim 5, further comprising a variable impedance feedback element at one of the inputs of said amplifier and wherein said circuit for varying said feedback element varies the value of both of said feedback elements.

7. A reference voltage source as in claim 5, wherein said circuit for varying comprises a logic circuit including an up/down counter controlled by the difference between said reference voltage and said target voltage to produce an output that varies the value of said variable impedance element.

8. A reference voltage source as in claim 6, wherein said circuit for varying comprises a logic circuit including an up/down counter controlled by the difference between said reference voltage and said target voltage to produce an output that varies the values of both of said variable impedance elements.

9. A reference voltage source as in claim 1 and further comprising a source of target voltage and a circuit for varying the signal applied to said amplifier second input to vary the gain of said amplifier to set said reference voltage to said target voltage.

* * * * *